US005330122A

United States Patent [19]

Wood

[11] Patent Number: 5,330,122

[45] Date of Patent: Jul. 19, 1994

[54] CABLE REEL ASSEMBLY

[75] Inventor: Michael Wood, Darlington, Australia

[73] Assignee: Harnischfeger of Australia P & Y Ltd., Bassendean, Australia

[21] Appl. No.: 875,169

[22] Filed: Apr. 28, 1992

[30] Foreign Application Priority Data

Feb. 12, 1992 [AU] Australia ..... PL0865

[51] Int. Cl.[5] ..... B65H 57/28

[52] U.S. Cl. ..... 242/158 B; 242/397.3

[58] Field of Search ..... 242/54 R, 158 B

[56] References Cited

U.S. PATENT DOCUMENTS

| | | | |
|---|---|---|---|
| 1,935,585 | 11/1933 | Tornblom | 242/158 B |
| 2,340,436 | 2/1944 | Stone et al. | 242/158 B |
| 2,904,284 | 9/1959 | Newsom | 242/158 B |
| 2,941,746 | 6/1960 | Hunt | 242/158 B |
| 3,218,034 | 11/1965 | Schat | 254/172 |
| 3,416,748 | 12/1968 | Bliss | 242/158 B |
| 3,474,976 | 10/1969 | Rushing et al. | 242/54 |
| 3,518,889 | 7/1970 | McLean | 242/158 B |
| 3,583,653 | 6/1971 | Bliss | 242/158 B |
| 3,589,632 | 6/1971 | Rew | 242/55 |
| 3,602,447 | 8/1971 | Fisher et al. | 242/158 B |
| 3,642,224 | 2/1972 | Tayor | 242/158 B |
| 3,807,617 | 4/1974 | Tanksley | 226/196 |
| 4,251,036 | 2/1981 | McLain | 242/158 B |
| 4,295,755 | 10/1981 | Meyers | 405/66 |
| 4,354,608 | 10/1982 | Wudtke | 212/191 |
| 4,371,147 | 2/1983 | Ridgway | 254/326 |
| 4,541,584 | 9/1985 | Rivinius | 242/158 B |
| 4,552,339 | 11/1985 | Werners et al. | 254/277 |
| 4,583,714 | 4/1986 | Ridgway | 254/326 |
| 4,700,851 | 10/1987 | Reeve et al. | 212/181 |

FOREIGN PATENT DOCUMENTS

| | | | |
|---|---|---|---|
| 280379 | 11/1913 | Fed. Rep. of Germany | 242/158 B |
| 3418026 | 11/1985 | Fed. Rep. of Germany . | |
| 3710132 | 10/1988 | Fed. Rep. of Germany . | |
| 3900783 | 10/1989 | Fed. Rep. of Germany . | |
| 1035526 | 8/1953 | France | 242/158 B |
| 2644445 | 9/1990 | France . | |
| 647565 | 10/1962 | Italy | 242/158 B |
| 623215 | 5/1949 | United Kingdom | 242/158 B |
| 1205879 | 9/1970 | United Kingdom | 242/158 B |

*Primary Examiner*—Thomas B. Will

*Attorney, Agent, or Firm*—Panitch Schwarze Jacobs & Nadel

[57] ABSTRACT

A cable reel assembly including a mounting frame (19), a cable drum (22) rotatably supported the mounting frame (19) and a drive motor (23) which drives rotation of the cable drum (22). Invention is characterized by the provision of a reeving carriage (35) for controlling movement of cable (29) wound onto the cable drum (22) when the cable is being paid out or hauled onto the cable drum (22) when said cable is being retrieved. There is also provided a horizontally orientated support rail (85A) wherein the reeving carriage (35) is adapted for reciprocatory movement relative to the support rail (85A). There is also provided a vertically orientated endless reeving member in the form of a chain (34) to cause the reciprocatory movement of the reeving carriage (35).

16 Claims, 7 Drawing Sheets

10
11
12
13
14
15
16
17
18
19
20
29
32
35A
36
38
39
40
41
42
43
44
47
48
49
49A

CABLE REEL ASSEMBLY

This invention relates to a cable reel assembly.

Conventional cable reel assemblies normally include a cable reel or cable drum rotatably mounted to a suitable support and a cable wound onto the cable drum which may be paid out or hauled back in as the case may be when carrying an article for loading or unloading purposes. Usually the cable drum may be rotated by drive means which may be in the form of an electric motor or hydraulic motor. The movement of the cable may be controlled by reeving apparatus which usually comprised a carriage mounted on an endless horizontally orientated reeving chain which was rotatably driven and wherein the carriage was therefore reciprocated back and forth across the chain engaging each run of the chain alternately.

The carriage was attached to the reeving chain by an attachment peg and it was found in practice that this reeving apparatus frequently broke down and was therefore subject to frequent maintenance or repair checks which was time consuming and inefficient especially if the cable reel assembly had to be transported to a repair or maintenance location.

Conventional cable reel apparatus is described in U.S. Pat. No. 4,700,851, U.S. Pat. No. 4,583,714, U.S. Pat. No. 4,371,147, U.S. Pat. No. 4,295,755, U.S. Pat. No. 3,807,617, U.S. Pat. No. 3,589,632, U.S. Pat. No. 3,747,976, U.S. Pat. No. 3,218,034, French Patent 2 644 445, German Patent 3 900 783, German Patent 3 710 132, German Patent 3 418 026, U.S. Pat. No. 4,552,339 and U.S. Pat. No. 4,354,608.

A feature of the abovementioned prior art references is that often the reeving apparatus described therein was highly specialised and designed for a certain specific application and thus was not susceptible to general usage whereby the cable reel assembly could be utilised in a number of different applications.

Thus for example U.S. Pat. No. 4,354,608 comprising a reeving apparatus which included a pair of upper stationary sheaves, a pair of mobile sheaves on a common axle and a counterweight secured to the axle which was fastened to the rod end of a hydraulic damping ram attached to the deck of a crane hoist. This particular reeving apparatus was primarily directed for use in a motion compensation system for a crane hoist to facilitate the crane operator in safely lifting loads from the deck of a heaving work boat. In another example U.S. Pat. No. 4,583,714 referred to a reeving apparatus comprising telescoping outrigger booms which are adjustably positioned on a bed frame whereby multiple guide rollers on the end of each outrigger boom open and lock closed to capture an associated power cable and to act as outriggers when laying or retrieving cable. This particular reeving apparatus was specifically directed to a truck mounted hydraulic cable reel apparatus for heavy power cable supported by a circular turntable.

It therefore is an object of the invention to provide a cable reel assembly which is simple in concept as well as construction.

A further object of the invention is to provide a cable reel assembly which is of a generalised nature and thus may be utilised for a variety of different applications.

The invention provides a cable reel assembly including:

mounting means;

a cable drum rotatably supported on the mounting means;

drive means for driving rotation of said cable drum;

a reeving carriage for controlling movement of cable wound onto said cable drum when said cable is being paid out or hauled onto said cable drum when the cable is being retrieved and a horizontally orientated support rail wherein the reeving carriage is adopted for reciprocatory movement relative to said support rail;

and a vertically orientated endless reeving member rotatably driven to cause said reciprocatory movement of said reeving carriage.

The mounting means may be of any suitable type and thus may incorporate a mounting frame having suitable frame members which are attached to a suitable support such as a boat deck or generally flat or planar surface by any suitable manner such as by bolts, rivets or other appropriate fasteners. The mounting frame may be rectangular or other suitable shape and the frame members may be girders or solid or more preferably hollow or tubular members such as RHS. The mounting frame may also be used to support the drive means and the reeving carriage, support rail and endless reeving member.

Preferably the mounting frame may also include a pair of opposed end frames with the cable reel assembly supported intermediate the end frames.

The cable drum may be driven by suitable drive means such as an air motor, electric motor or internal combustion engine. Preferably the cable drum has a common axle or one stub axle which is directly attached to an output shaft of the motor or more suitably attached to the output shaft by a reduction gear box. The other end of the common axle or other stub axle may be attached to bearing means supported by one end frame. The other end frame may support the drive means and associated bearing means.

Preferably the endless reeving member may comprise a line member such as a cable, cord chain or the like rotatably supported by a pair of guides wherein each guide is mounted to an associated end frame of the mounting frame. The guides may comprise a driven guide such as a drive sprocket or pulley and an idler guide such as an idler sprocket or pulley. Preferably however a reeving chain is utilised supported by a drive sprocket and idler sprocket. Preferably the drive sprocket is driven by a drive motor of the cable drum through suitable transmission means such as a chain drive or belt drive from a sprocket or pulley attached to one end of the cable drum. The chain drive may be coupled to the drive sprocket of the reeving chain by a right angle reduction gear box or other suitable coupling.

Other suitable drive means (eg. by a drive motor directly attached to the drive sprocket of the reeving chain) may be used if required.

The reeving carriage preferably has a drive pin which is attached to one run of the reeving chain with the other run of the reeving chain being free of the reeving carriage during movement of the reeving carriage. The drive member may be slidably attached to the reeving carriage so that it is reciprocatable in an up or down direction relative to the reeving carriage when one end of the reeving chain is encountered. This may be achieved by mounting the drive pin in opposed slideways or grooves in a body part of the reeving carriage. In this arrangement the drive member may be attached to a support member which is movable in the opposed slideways. The drive member may be rotatably mounted to the support member by appropriate bearings.

The reeving carriage may also be provided with a cable aperture or slot for passage of the actuating cable and such aperture or slot may be bounded by appropriate rollers e.g. by a set of opposed vertical rollers and a set of opposed horizontal rollers.

The reeving carriage may also be provided with bearing means so that the reeving carriage may travel along the support rail. One suitable bearing means may comprise a a plurality of bearing rollers.

Reference may now be made to a preferred embodiment of the invention as shown in the attached drawings wherein FIG. 1 is a side view of a launching and/or retrieving apparatus utilising the cable reel assembly of the invention;

Figure 1:
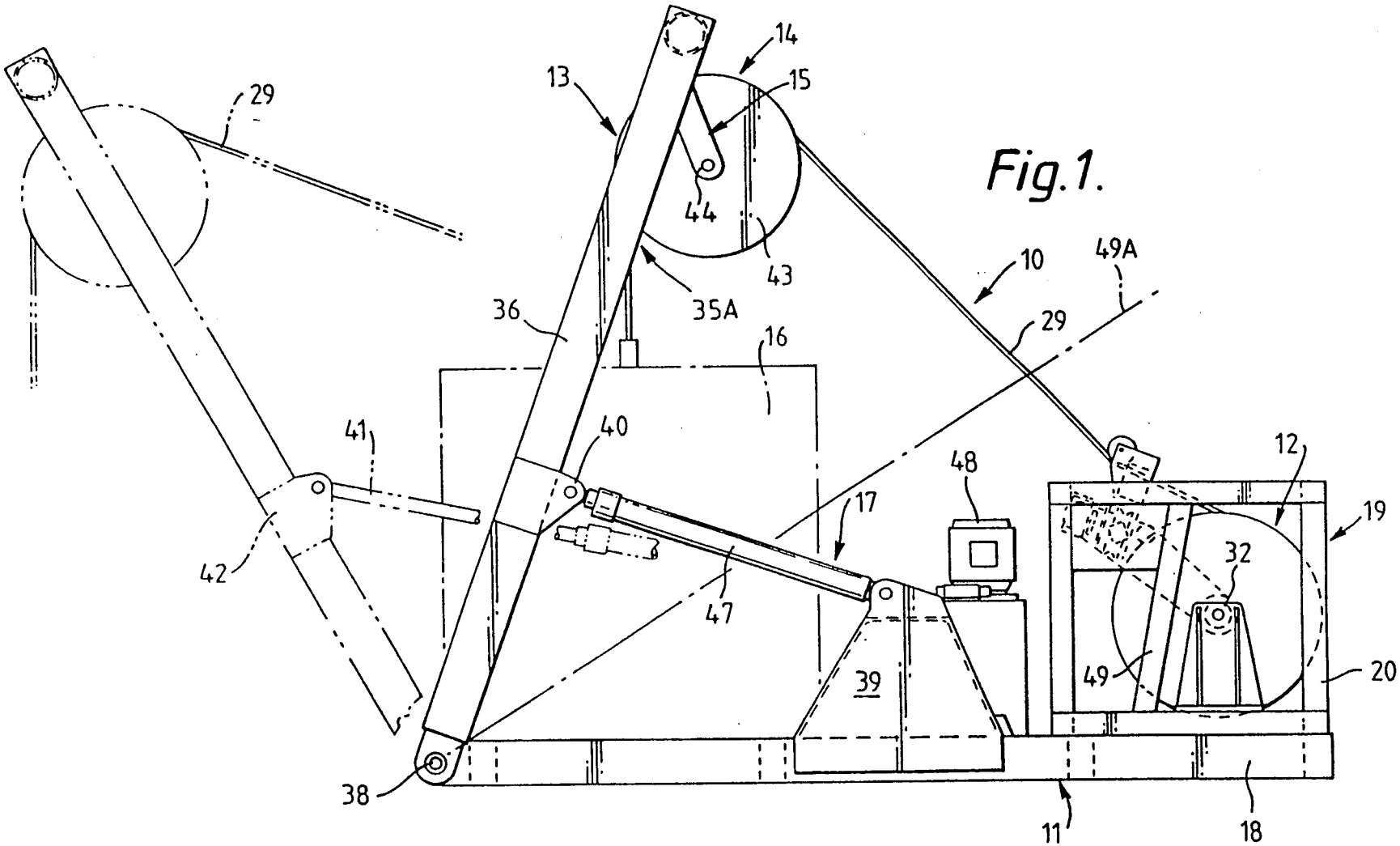
Figure 2:
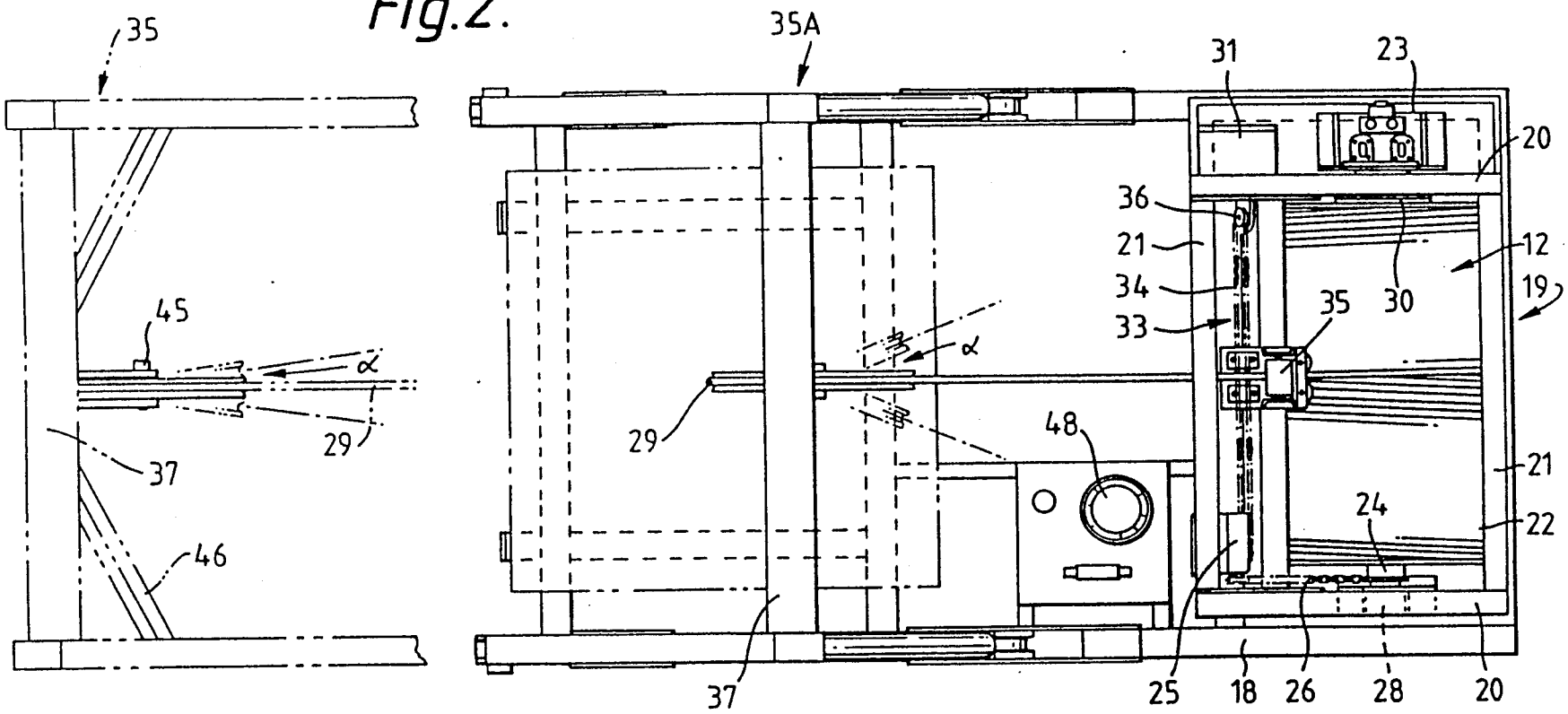
FIG. 2 is a top plan view of the launching and/or retrieving apparatus shown in FIG. 1.

In FIGS. 1 and 2 there is shown launching and/or retrieval apparatus 10 including support frame 11, cable reel assembly 12, cable support means 13, guide means 14, pivotal attachment means 15, article 16 which requires launching and/or retrieval and a pair of hydraulic ram assemblies 17 for actuating pivotal movement of cable support means 13 relative to support frame 11.

The support frame 11 includes base frame members 18 and mounting frame 19 for supporting cable reel assembly 12 which includes opposed end frames 20 as well as transverse frame members 21 of mounting frame 19. The cable reel assembly 12 includes drum 22, drive motor 23 for effecting rotation of drum 22, drive sprocket 24, right angle reduction gear box 25, transmission chain 26 interconnecting sprocket 24 with gearbox 25, bearing 28, actuating cable 29, and epicyclic speed reducer 30 coupled to motor 23 and to drum 22. There is also shown junction box 31 and slip ring assembly 32.

The reeving apparatus 33 includes endless reeving chain 34, reeving carriage 35 and end sprocket 36 for chain 34.

The cable support means 13 includes frame 35A which has opposed uprights 36 and crossbar 37. Each upright 36 is pivotally attached to members 18 at 38. There is also included support brackets 39 for hydraulic ram assemblies 17 which are pivotally attached to an associated support bracket at 40. The piston rod 41 of each hydraulic ram assembly is pivotally attached to attachment brackets 42 of each upright 36. The guide means 14 includes a sheave wheel 43 rotatably supported to sheave yoke 44 by bolt 45. The cable support frame 35A also includes bracing members 46. Each hydraulic ram assembly 17 also includes cylinder 47 and is driven by hydraulic power unit 48. Each end frame 20 also includes bracing members 49.

There is included line 49A shown in phantom which indicates the position of cable support means 11 in the stowed or transportation position.

In FIGS. 3-6 the drive train for the drum 22 is shown whereby motor 23 may be of pneumatically actuated, hydraulically actuated or electrically actuated as the case may be. Sprocket 74 is connected by transmission chain 75 to sprocket 76 which is attached directly to cable reel or drum 22. As the cable reel 22 rotates the output sprocket 24 attached to the other end of reel 22 drives gear reducer input sprocket 77 via chain 26. There is also provided a chain tension assembly best shown in FIG. 8 for chain 26. Sprocket 78 on the output shaft of gear box 25 drives reeving chain 34 which is maintained in a substantially vertical orientation as shown. Reeving chain 34 is tensioned by idler sprocket 79.

Figure 6:
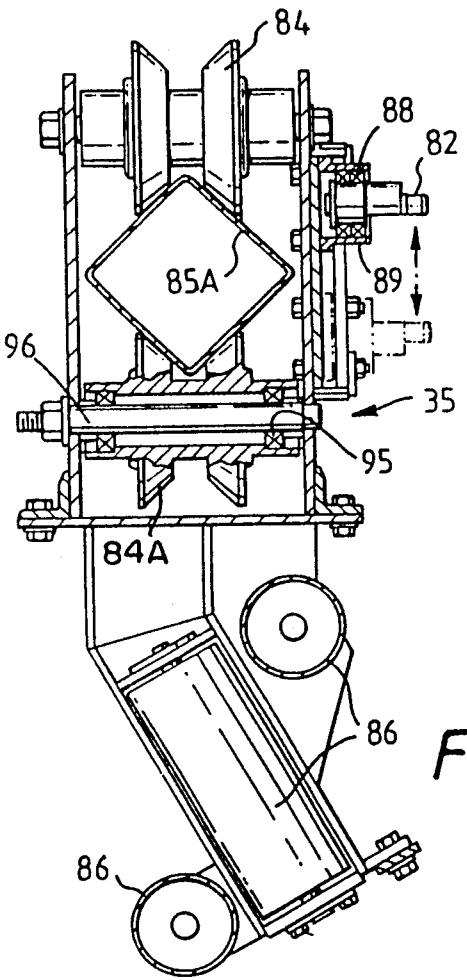
FIG. 6 shows a side sectional view of the reeving carriage.

The reeving carriage 35 is attached on upper run 80 of reeving chain 34 by drive pin 82. When reeving chain 34 rotates reeving carriage 35 is moved therealong linearly from end to end of mounting frame 19. As carriage 35 reaches either end of mounting frame 19, drive pin 82 rotates around either sprocket 78 or idler sprocket 79 and on its own axis as it moves up or down in slideways 83 formed by adjacent body plates 83A and 85 (best shown in FIG. 4) of carriage 35 to change direction. The actuating cable 29 is reeved at the correct fleet angle onto or off reel 22 via selected sprocket ratios according to the size of cable used. The carriage 35 is supported on upper rollers 84 and tracks also with the aid of lower rollers 84A on a RHS tube 85A mounted at 45 degrees to the horizontal as shown in FIG. 6. The cable is fully guided by the rollers 86 as it passes through aperture 87.

The drive pin 82 is bounded by bearings 88 and is supported by stationary base 89. The triplex joiner 81 has attachment rods 90 which extend through apertures 91 in drive pin 82. Circlips 92 and a triplex joiner 93 and clip 94 are also shown. Bearings 95 for axle 96 of rollers are also shown.

In operation as shown in FIGS. 1-2 the frame 35A may pivot from an inoperative position shown in full outline on the right in FIG. 1 to an operative position shown in phantom outline on the left by actuation of piston rods 41 of ram assemblies 17 which function in unison as shown. The pivoting of sheave 43 is also indicated in phantom in both the inoperative and operative positions. Preferably the maximum angle $\alpha$ shown in the inoperative position or the operative position is 40°.

Figure 3:
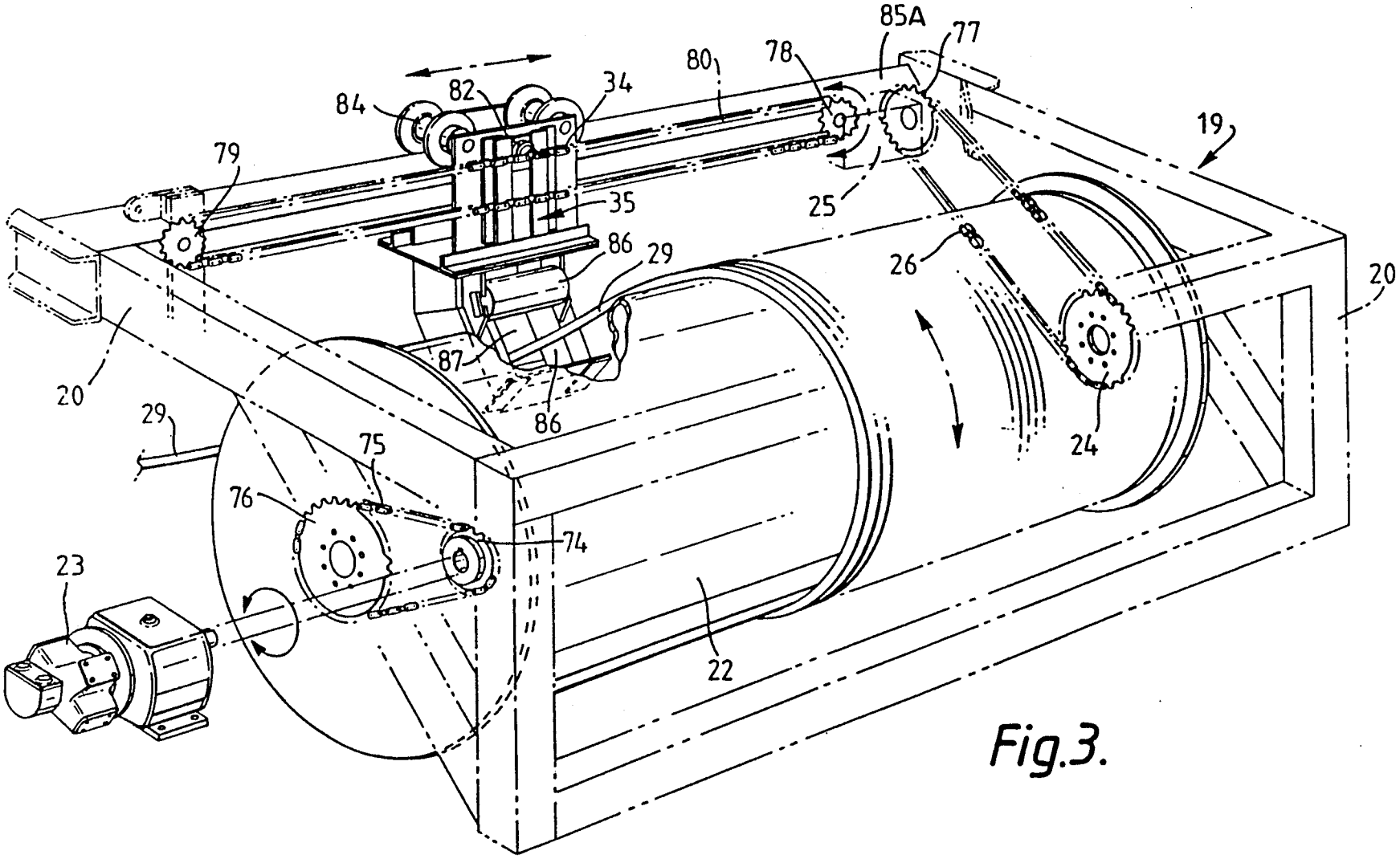
FIG. 3 shows a perspective view of the cable reel assembly showing the reeving apparatus.
Figure 4:
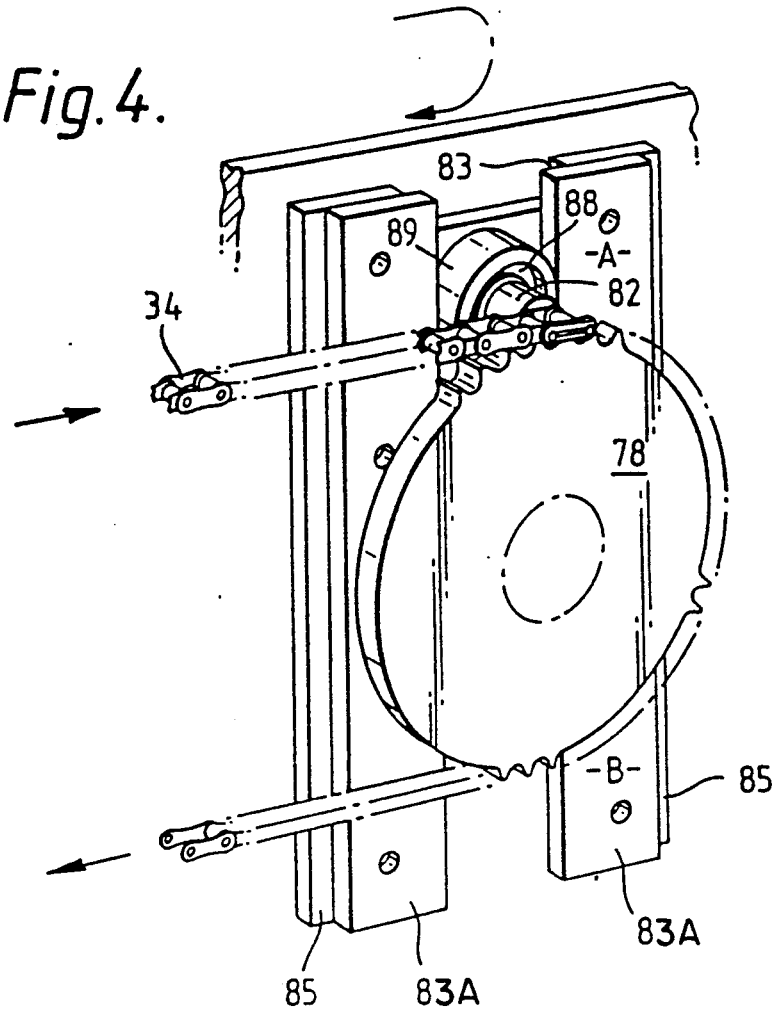
FIG. 4 is a perspective view of the reeving carriage at one end of the reeving chain.
Figure 5:
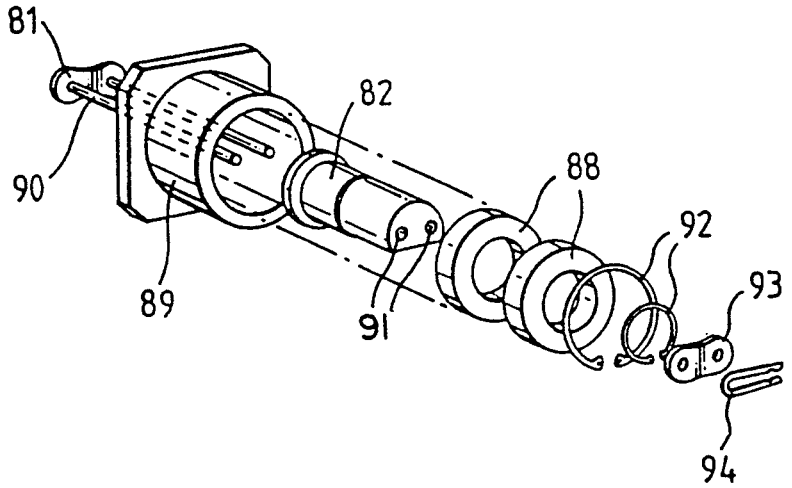
FIG. 5 shows an exploded perspective view of the drive pin assembly for attachment of the reeving carriage to the reeving chain.
Figure 7:
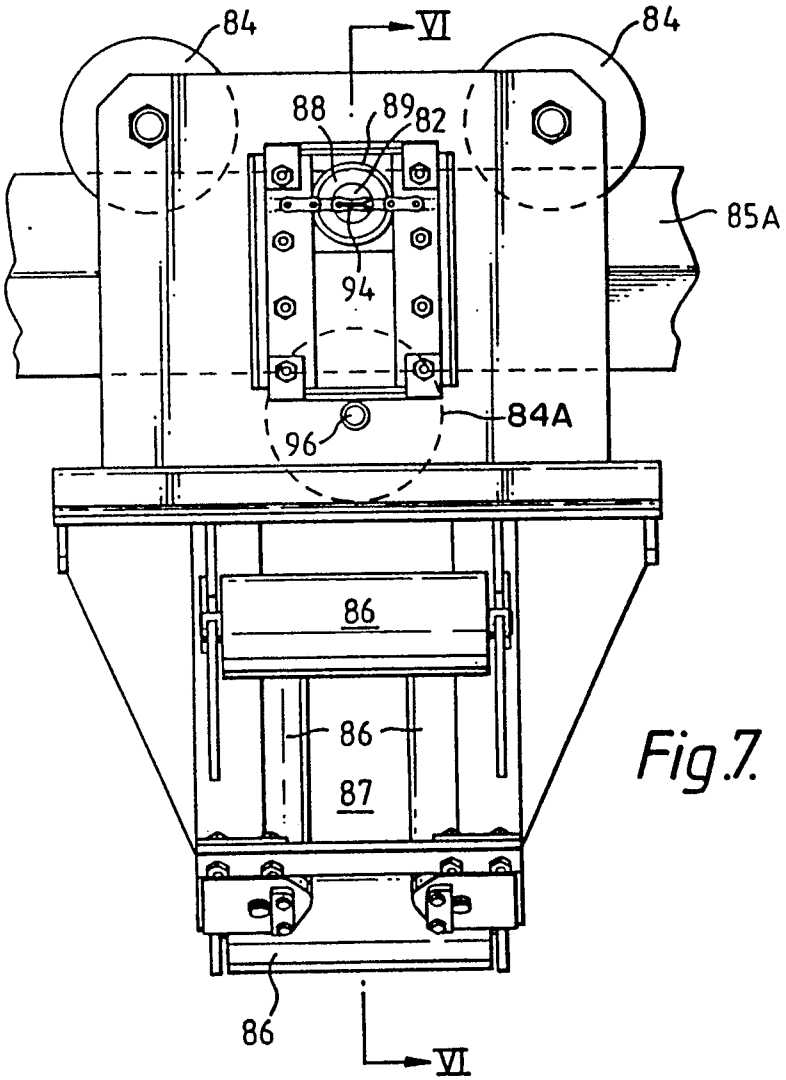
FIG. 7 shows a front view of the reeving carriage shown in FIG. 6.
Figure 8:
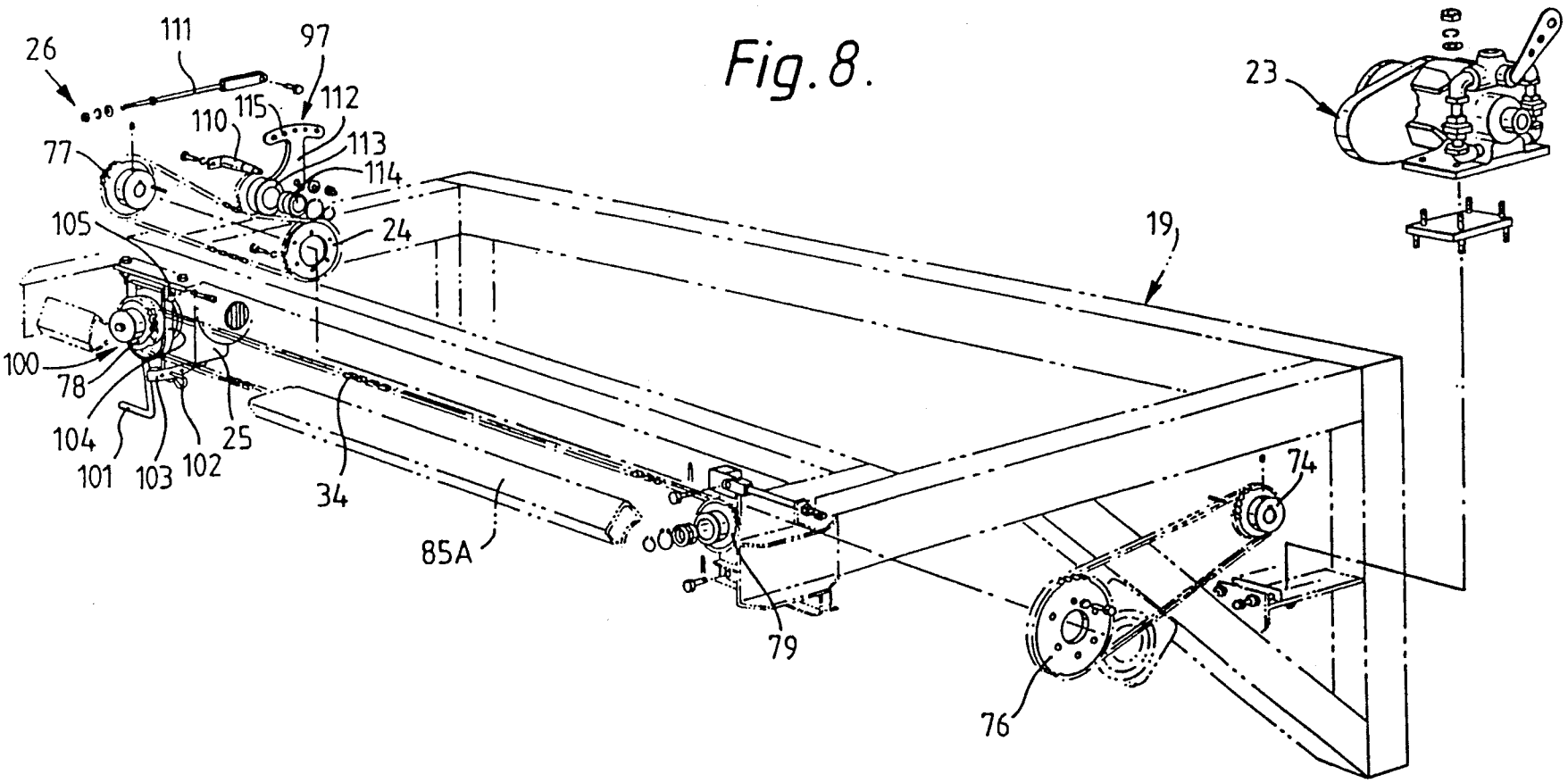
FIG. 8 shows a more detailed view of the drive train for the reeving assembly than that shown in FIG. 3.

FIG. 8 shows a more detailed view of the drive train shown in FIG. 3 wherein similar reference numerals have been included. Of particular relevance is the chain tensioner mechanism 97 for tensioning of chain 26 which includes chain tension rod 111, tension fulcrum bolt 110, bell crank 112, idler sprocket 113 and bearing. 114. It will be noted that the tension in chain 26 can be selectively varied by engagement of tension rod 111 in a selected aperture 115 of bell crank 112.

Figure 10:
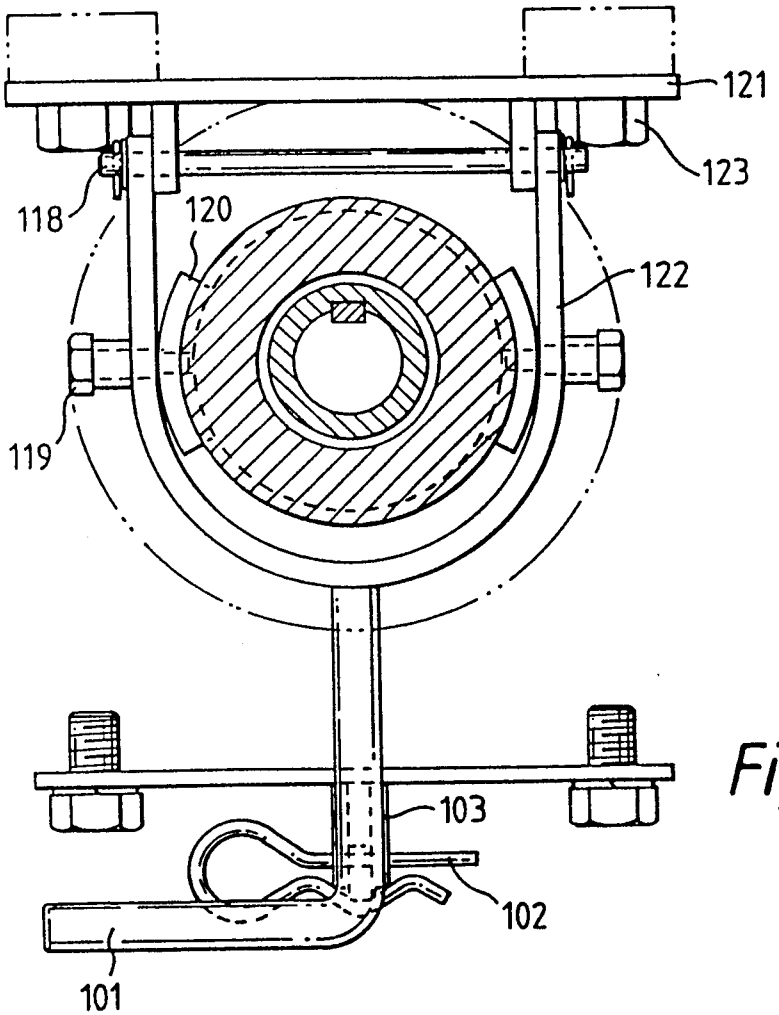
FIGS. 9-10 show alternative views of the clutch assembly which couples drive of the reeving chain to the drive train.
Figure 9:
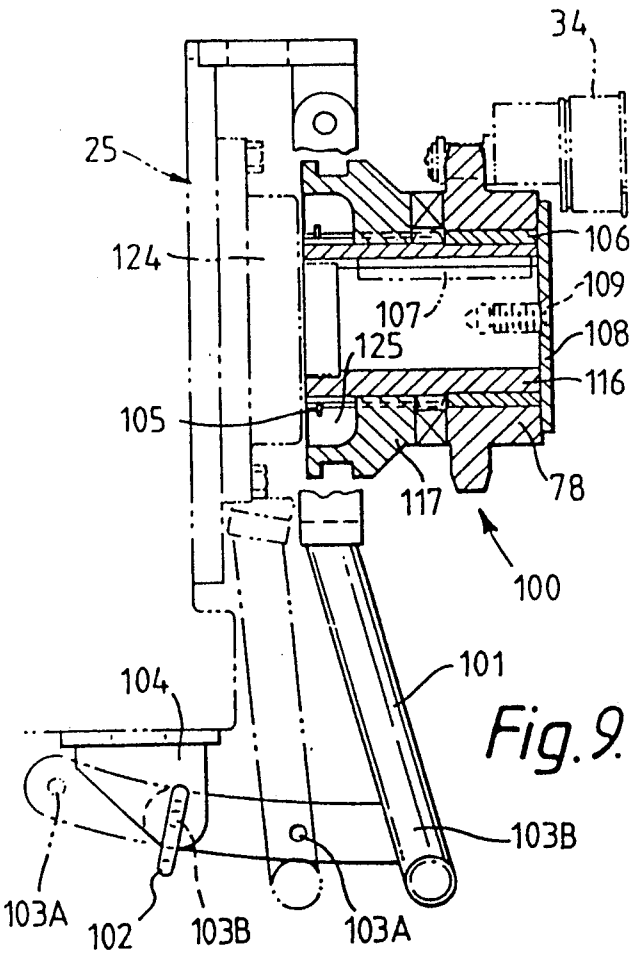

A clutch assembly 100 is also shown for selectively disengaging sprocket 78 with right angle gear box 25. This is shown in more detail in FIGS. 9-10. In the clutch assembly there is shown actuating handle 101, circlip 102 for locking handle in a desired position in a selected aperture 103A or 103B in handle lock bracket 104. Aperture 103A corresponds to a position wherein the reeving drive sprocket 78 is in a drive position and aperture 103B corresponds to a position when drive sprocket 78 is uncoupled from driven engagement with right angle gearbox 25. In this regard sprocket 78 may be then rotated manually if desired to also manually initiate movement of reeving chain 34. There is also shown external circlip 105, bush 106, key 107, retainer 108, socket screw 109, splined sleeve 116, drive dog 117, pivot pin 118, slipper retaining pin 119, actuating slipper 120, bracket 121, and U shaped extension 122 of handle 101, and bolts 123 for attachment of bracket 104 to gearbox 25. There is also shown output member 124 of gearbox 25 which engages in socket 125 of drive dog 117 in the driven position and which is uncoupled from engagement with socket 125 in the manually rotatable position.

A feature of the invention and in particular the reeving means of the cable reel assembly 12 is that if the cable exceeds an angle $\alpha$ to the longitudinal axis of the launching and/or retrieval apparatus (ie. normal to the axis of mounting frame 19) then the triplex joiner 81 may shear which will protect loss of cable 29 in an over stress situation during operation which is extremely expensive. A suitable value of angle $\alpha$ is 40° .

It will also be appreciated that the cable reel assembly of the invention is a simple mechanism and can be used in a variety of applications as will be apparent to the person skilled in the art. Thus in addition to the illustrated embodiment which concerns a launching and retrieving apparatus for launching and retrieving articles from boats the cable reel assembly of the invention may be used for laying and installation of power cable for mining applications as well as a crane hoist. The cable reel assembly of the invention may also be supported by vehicles such as trucks for installation of articles where required.

The vertical orientation of the endless reeving chain and associated support rail allows the reeving carriage to reciprocate back and forth across the support rail thereby providing a very efficient reeving mechanism which may operate for relatively long periods of time without it being necessary to make maintenance or repair checks. This considerably reduces down time in relation to operation of the cable reel assembly and thus the cable reel assembly may operate in a far more efficient and economic manner when compared to the prior art.

I claim:

1. A cable reel assembly including:

(i) a mounting frame;

(ii) a cable drum rotatably supported on the mounting frame;

(iii) drive means for driving rotation of the cable drum;

(iv) a reeving carriage for controlling movement of cable in relation to the cable drum which includes an upper roller means and a lower roller means mounted on a roller mounting frame, a rail aperture located between the upper roller means and the lower roller means and a cable roller assembly located below the roller mounting frame having a cable aperture for passage of the cable;

(v) a horizontally oriented support rail which passes through the rail aperture, the support rail being rhombus shaped in cross section, and including a plurality of bearing surfaces each of which is offset to the horizontal for bearing contact with the upper roller means and the lower roller means, the support rail being located above a longitudinal axis of the cable drum, whereby the reeving carriage is adapted for reciprocatory movement relative to the support rail; and (vi) an endless reeving member having upper and lower segments oriented in a vertical plane, the endless reeving member being rotatably driven to cause the reciprocatory movement of the reeving carriage.

2. A cable reel assembly as claimed in claim 1, wherein the reeving member comprises an endless chain rotatably supported by a pair of guides wherein each guide is attached to the mounting frame.

3. A cable reel assembly as claimed in claim 2, wherein one guide is a driven guide and the other guide is an idler guide.

4. A cable reel assembly as claimed in claim 3, wherein the driven guide is driven by the drive means through transmission means.

5. A cable reel assembly as claimed in claim 4, wherein the transmission means comprises a chain drive from a sprocket attached to one end of the cable drum.

6. A cable reel assembly as claimed in claim 5, wherein the chain drive is coupled to a driving sprocket of the reeving chain by a right angle reduction gear box.

7. A cable reel assembly as claimed in claim 6, wherein there is provided clutch means for selectively engaging the driving sprocket to the right angle reduction gearbox for manual rotation of the driving sprocket when uncoupled from the right angle reduction gear box.

8. A cable reel assembly as claimed in claim 1, wherein the reeving carriage has a drive member slidably attached to one run of the reeving member so that the drive member is reciprocatable in a vertical direction relative to the reeving member when one end of the reeving member is encountered.

9. A cable reel assembly as claimed in claim 8, wherein the drive member is mounted in opposed slideways of a body part of the reeving carriage.

10. A cable reel assembly as claimed in claim 9 wherein the drive member is rotatably mounted to a support member which is movable in the opposed slideways.

11. A cable reel assembly as claimed in claim 1 wherein the horizontally oriented support rail is tubular.

12. A cable reel assembly as claimed in claim 1, wherein the upper roller means and the lower roller means include tapered roller surfaces for intimate contact with adjacent bearing surfaces of the support rail.

13. A cable reel assembly as claimed in claim 1, wherein the cable roller assembly includes a pair of opposed horizontal rollers and a pair of opposed substantially vertical rollers.

14. A cable reel assembly as claimed in claim 13, wherein the substantially vertical rollers are oriented at an oblique angle to the horizontal in side elevation and each horizontal roller is located on different sides of a common plane of the substantially vertical rollers.

15. A cable reel assembly as claimed in claim 14, wherein each horizontal roller is located adjacent respective ends of the substantially vertical rollers.

16. A cable reel assembly including:

mounting means;

a cable drum rotatably supported on the mounting means;

drive means for driving rotation of the cable drum;

a reeving carriage for controlling movement of cable wound onto the cable drum when the cable is being paid out or hauled onto the cable drum when the cable is being retrieved and a horizontally orientated support rail wherein the reeving carriage is adapted for reciprocatory movement relative to said support rail; and a vertically oriented endless reeving member rotatably driven to cause the reciprocatory movement of the reeving carriage;

the reeving carriage having a drive member slidably attached to one run of the reeving member so that the drive member is reciprocatable in a vertical direction relative to the reeving member when one end of the reeving member is encountered, the drive member being mounted in opposed slideways of a body part of the reeving carriage and rotatably mounted to a support member which is movable in the opposed slideways, the support member being attached to the one run of the reeving member by a shear member which is adapted to shear to prevent loss of cable when the cable may exceed an acute angle to an axis located normal to the mounting means.

* * * * *